US010155603B2

(12) United States Patent
Hellenbrand et al.

(10) Patent No.: US 10,155,603 B2
(45) Date of Patent: Dec. 18, 2018

(54) APPARATUS FOR PACKAGING INDIVIDUAL MEDICATION DOSES AND METHOD FOR ITS OPERATION

(71) Applicant: CareFusion Germany 326 GmbH, Kelberg (DE)

(72) Inventors: Christoph Hellenbrand, Kaifenheim (DE); Minne Jorritsma, Amsterdam (NL)

(73) Assignee: CareFusion Germany 326 GmbH, Kelberg (DE)

( * ) Notice: Subject to any disclaimer, the term of this patent is extended or adjusted under 35 U.S.C. 154(b) by 635 days.

(21) Appl. No.: 14/689,160

(22) Filed: Apr. 17, 2015

(65) Prior Publication Data

US 2016/0304228 A1 Oct. 20, 2016

(51) Int. Cl.

| | |
|---|---|
| ***B65B 57/04*** | (2006.01) |
| ***B65B 9/08*** | (2012.01) |
| ***B65B 57/02*** | (2006.01) |
| ***B65B 61/02*** | (2006.01) |

(52) U.S. Cl.

CPC ..... *B65B 57/04* (2013.01); *B65B 9/08* (2013.01); *B65B 57/02* (2013.01); *B65B 61/025* (2013.01)

(58) Field of Classification Search

CPC ..... B65B 57/04; B65B 9/08; B65B 61/025; B65B 61/26; B65B 57/02–57/16

USPC ..... 53/53, 54, 131.2, 167

See application file for complete search history.

(56) References Cited

U.S. PATENT DOCUMENTS 4,307,555 A * 12/1981 Mlodozeniec ..... A61J 3/00 53/53
5,709,063 A * 1/1998 Yuyama ..... B65B 1/06 53/154
8,340,392 B2 * 12/2012 Kim ..... G01B 11/24 348/125

(Continued)

FOREIGN PATENT DOCUMENTS

DE 102008047975 4/2010
EP 1 759 998 A1 3/2007

(Continued)

OTHER PUBLICATIONS

Search Report from corresponding EP Appln. No. 15163950.7 dated Oct. 27, 2015 (7 pages).

*Primary Examiner* — Andrew M Tecco
*Assistant Examiner* — Praachi M Pathak
(74) *Attorney, Agent, or Firm* — Morgan, Lewis & Bockius LLP

(57) ABSTRACT

An apparatus and method for packaging individual medication doses in blister bags includes a plurality of storage and dispensing stations, at least one guide and collection arrangement for picking up the medication doses and passing them on, or conducting them, to a packaging station, the packaging station forming a strand of connected blister bags from packaging material. Also included is a labeling and printing station for applying data to the packaging material, an optical detection device that optically detects characteristics of the individual blister bags of the strand, an evaluation device that compares the characteristics detected for an individual blister bag with reference characteristics, and a storage station that stores the strand of the blister bags in an ordered manner.

6 Claims, 4 Drawing Sheets

(56) References Cited

U.S. PATENT DOCUMENTS

| | | | | |
|---|---|---|---|---|
| 2008/0190076 | A1* | 8/2008 | Klingel | B65B 5/103 53/493 |
| 2009/0260739 | A1* | 10/2009 | Fischer | B41J 3/407 156/64 |
| 2014/0318078 | A1 | 10/2014 | Kondo et al. | |

FOREIGN PATENT DOCUMENTS

| | | | |
|---|---|---|---|
| EP | 2 067 699 | A1 | 6/2009 |
| JP | H11 206854 | A | 8/1999 |

* cited by examiner

APPARATUS FOR PACKAGING INDIVIDUAL MEDICATION DOSES AND METHOD FOR ITS OPERATION

BACKGROUND

The present disclosure relates to an apparatus for packaging individual medication doses.

In many medical treatment settings, it is desirable to provide a packaging apparatus and method for packaging individual medication doses for which the number of defectively produced blister bags is reduced. For example, systematic errors may be recognized during application of printed data to the blister bags, and the apparatus may be stopped, if necessary, so that production of a large number of defective blister bags may be prevented.

SUMMARY

The disclosed embodiments provide an apparatus for packaging individual medication doses. The apparatus includes a plurality of storage and dispensing stations configured to dispense individual medication doses and at least one guide and collection arrangement configured to pick up the medication doses dispensed by the storage and dispensing stations and conduct dispensed medication doses. The apparatus also includes a packaging station coupled with a control device and configured to receive the conducted, carried, or guided dispensed medication doses, form a strand of connected blister bags from a received packaging material, and introduce the dispensed medication doses into the blister bags when forming the blister bags. The apparatus further includes an optical detection device coupled with the control device and configured to optically detect characteristics of an individual blister bag of the strand and an evaluation device coupled with the control device and configured to compare the characteristics detected for the individual blister bag with reference characteristics.

The disclosed embodiments also provide a method for operating an apparatus for packaging individual medication doses. The method includes making order data available to a control device, wherein the order data relate to medication compilations, each medication compilation having at least one medication dose and dispensing medication doses of a medication compilation from a plurality of storage and dispensing stations based on the order data. The method also includes passing, or conducting, the dispensed medication compilations to a packaging station, applying data, by a labeling and printing station, at predetermined application locations of packaging material, and forming a strand of connected blister bags by the packaging station from the packaging material. The method further includes assigning the applied data to each connected blister bag, introducing the dispensed medication compilations into the blister bags while the blister bags are formed, and passing, or conducting, the strand to an optical detection device. The method also includes detecting characteristics of a blister bag, comparing the detected characteristics of the blister bag with reference characteristics, and triggering a reaction assigned to a deviation if a deviation between the detected characteristics and the reference characteristics is found. The method further includes placing the strand of blister bags in storage.

The disclosed embodiments also provide a method for operating an apparatus for packaging individual medication doses. The method includes making order data related to medication compilations available to a control device, each medication compilation having at least one medication dose and dispensing medication doses of a medication compilation from a plurality of storage and dispensing stations based on the order data. The method also includes passing, or conducting, the dispensed medication compilations to a packaging station, applying data at predetermined application locations of packaging material, and forming a strand of connected blister bags from the packaging material. The method further includes introducing the dispensed medication compilations into the blister bags, detecting and comparing characteristics of a blister bag with reference characteristics, and triggering a reaction assigned to a deviation if a deviation between the detected characteristics and the reference characteristics is found.

BRIEF DESCRIPTION OF THE DRAWINGS

In the following, two preferred embodiments of the apparatus according to the disclosure as well as a preferred embodiment of the method according to the disclosure are described, making reference to the attached drawings, in which.

DETAILED DESCRIPTION OF THE PREFERRED EMBODIMENTS

Figure 1:
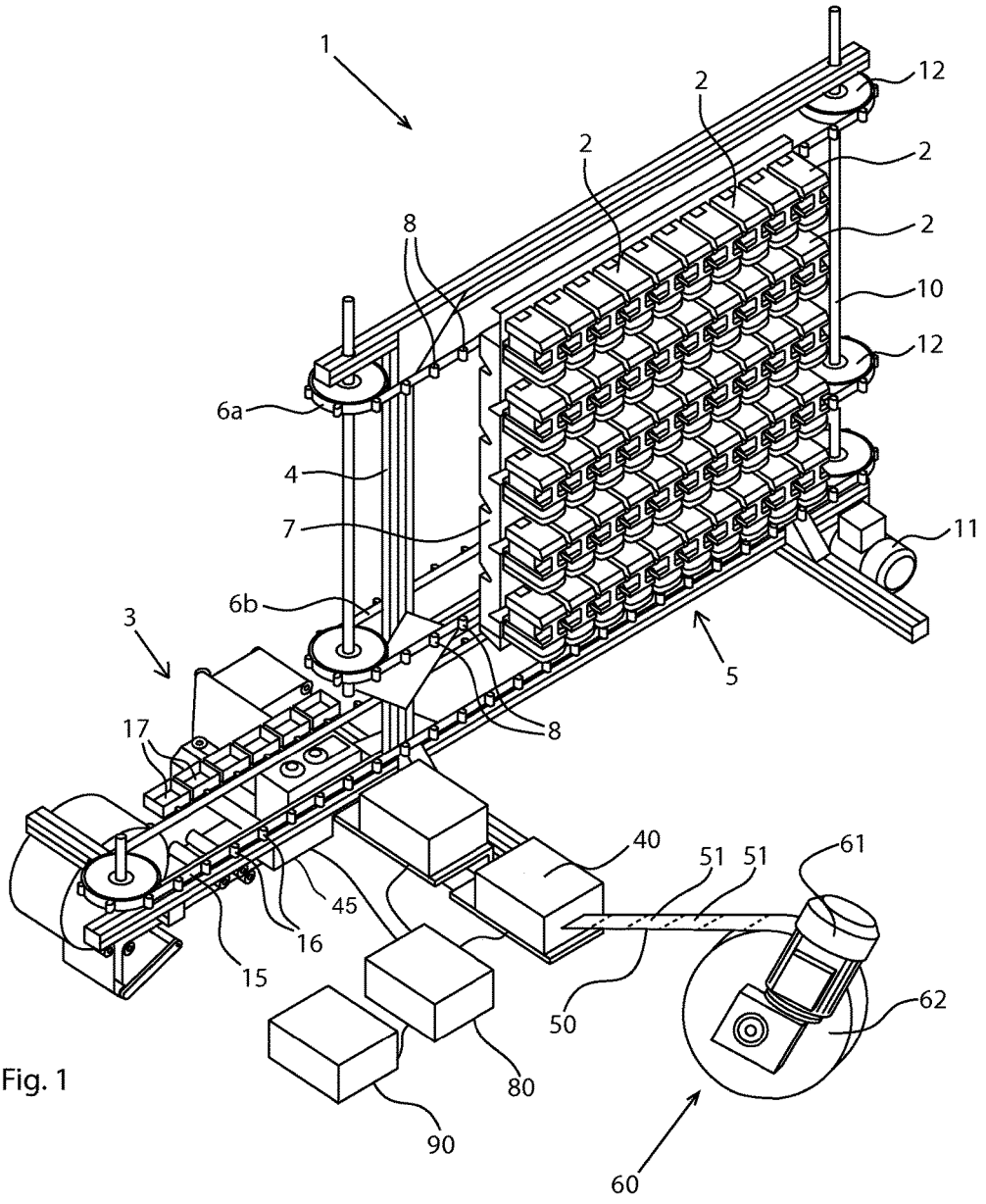
FIG. 1 is a perspective view of an embodiment of an apparatus for packaging individual medication doses.

The detailed description set forth below describes various configurations of the subject technology and is not intended to represent the only configurations in which the subject technology may be practiced. The detailed description includes specific details for the purpose of providing a thorough understanding of the subject technology. Accordingly, dimensions are provided in regard to certain aspects as non-limiting examples. However, it will be apparent to those skilled in the art that the subject technology may be practiced without these specific details. In some instances, well-known structures and components are shown in block diagram form in order to avoid obscuring the concepts of the subject technology.

It is to be understood that the present disclosure includes examples of the subject technology and does not limit the scope of the appended claims. Various aspects of the subject technology will now be disclosed according to particular but non-limiting examples. Various embodiments described in the present disclosure may be carried out in different ways and variations, and in accordance with a desired application or implementation.

Automatic blister packaging machines are usable in pharmacies and hospitals, or, with appropriate dimensioning, also in blister packaging centers, which machine compiles medication compilations composed of multiple medication doses individually per patient, in accordance with the doctor's prescribed times of administration. The apparatus packages medication compilations (which may comprise merely a single medication dose or a plurality of individual medication doses) corresponding to order data, in bags formed from a web of packaging material, called blister bags, wherein these bags leave the packaging apparatus as a strand of blister bags (also called a "blister tube") for further use. In this connection, a blister bag regularly corresponds to an administration time of a patient, i.e. it contains all the medication doses that a patient must take at a predetermined time of day. The order data themselves may be data derived from prescriptions or the like.

The typical apparatus for packaging individual medication doses includes multiple storage and dispensing stations for medication doses, which interact with multiple circulating guide devices, which pass, or conduct, the medication doses to also circulating collection devices, which pass, or conduct, the medication compilations to a packaging station in which the blister bags are formed and the individual medication doses are introduced into the blister bags as they are formed. Because of the special method of construction of the apparatus described above, a plurality of blister bags is produced per hour, and corresponding marking of the blister bags is therefore of decisive importance.

Marking of the blister bags after introduction of the individual medication doses is not practicable, because the medication doses may be damaged when applying data that identify the content of the blister bag, among other things. Application of the corresponding data therefore takes place before the actual blister packaging, i.e. forming the blister bag and introducing the medication doses during forming. For this purpose, a labeling or printing device is disposed ahead of the actual packaging location, which device applies data corresponding to the order data to the packaging material, where these data clearly identify the blister bag that is subsequently produced and reflect the content of each blister bag.

If a (systematic) error occurs during application of the data to the packaging material (e.g., printed image blurred or unreadable, offset, only partially applied), the error may not be determined by a user or may only be determined with great difficulty, because of the working speed and the type of applied data (e.g., barcode or the like), so that possibly a large number of defective blister bags will be produced before the error is noted by a user. Furthermore, it may happen that a systematic error is present with regard to production of the blister bags. For example, if a medication dose that is frequently requested is no longer on hand, and if this is not determined by a related storage and dispensing station.

The disclosed embodiments provide an apparatus for packaging individual medication doses. The apparatus includes multiple storage and dispensing stations for dispensing individual medication doses, at least one guide and collection arrangement for picking up the medication doses dispensed by the storage and dispensing stations and passing these medication doses on, or conducting, to a packaging station coupled with a control device, which station forms a strand of connected blister bags from packaging material that is made available and introduces the dispensed medication doses into the blister bags as the blister bags are being formed. As a function of the precise configuration of the apparatus, one or a plurality of guide and collection arrangements may be used. This arrangement or these arrangements may be structured in one piece, but it is also provided that the guide and collection arrangements comprise separate guide and collection devices.

The apparatus furthermore comprises a labeling or printing station coupled with the control device, for applying data predetermined by the control device to the packaging material of each blister bag to be formed in the packaging station, in a predetermined arrangement. The data to be applied are applied in a predetermined arrangement (e.g., on a predetermined section of the packaging material, and thereby of the subsequent blister bag), and may include the date of production of the blister bag, the precise content, and, if applicable, information concerning the expiration date of the content of the blister bag. The method of applying the data is not essential to the present disclosure. For example, the data may be printed onto the packaging material, but it is also conceivable that pre-printed labels are adhesively attached to the packaging material at a predetermined location.

Furthermore, it is not significant what type of data is applied. For example, it is possible that the data are applied so as to be "readable" for a user (e.g., the patient's name and the content of the blister bag, the type of individual medication doses) are printed on or adhesively attached, along with other data, if applicable. It is also conceivable, however, that a barcode is applied, which is supplemented or replaced with additional data at a later point in time, if necessary. As a function of the respective embodiment, the labeling or printing station may be part of the packaging station (e.g., the two stations are combined in a component group). Alternatively, the labeling or printing station may be a separate component, which might improve accessibility in the event of a problem. Independent of the method of application of the data and of the type of data themselves, it is essential that the applied data may be read by a user or a machine at a later point in time.

The apparatus according to the disclosure further includes an optical detection device coupled with the control device, which optically detects characteristics of the individual blister bags of the strand, and an evaluation device coupled with the control device, which compares the characteristics detected for an individual blister bag with reference characteristics. The evaluation device may be integrated into the control device. It is also conceivable that the function of the two devices is performed by a common component, for example a computer.

The detected characteristics may be, for example, merely the location of application of the data on the blister bag. If it is determined, during a comparison with reference characteristics, that the data are applied at a location that is unsuitable for subsequent detection of the data by machine, this may indicate a systematic error in the application of the data (for example if five or more blister bags in a row demonstrate the same defect), and the apparatus is stopped, if necessary, with the precise reactions to the determination of a deviation between detected characteristics and reference characteristics being dependent on the type and frequency of the deviations. In the simplest case, it is therefore merely determined whether or not application of the data as such is functioning without problems.

The optical detection device may, however, also include a detector or detecting device that detects the number and size of the individual medication doses introduced into a blister bag. If the reference characteristics are derived from the order data relating to a blister bag (e.g., it is stipulated in the reference data how many medication doses are supposed to be contained in a blister bag), a bag-specific deviation may also be determined in this manner. For example, if it is determined that while the data has been applied to the blister bag correctly, the correct number of individual medication doses has not been introduced into a blister bag due to a malfunction of the apparatus.

To store the strand of connected blister bags that has been produced, the apparatus may further include a storage station in which the strand is stored in an ordered manner. "Ordered" storage means that the strand of connected blister bags is rolled up, for example, or folded in accordance with special instructions. The storage station may be disposed within the apparatus, but placement outside of the actual apparatus is also possible, in order to improve accessibility.

In order to allow recognition of the occurrence of a systematic error, if applicable, the optical detection device is disposed between the packaging station and the storage station.

As has discussed above, systematic errors (e.g., application of the data at the wrong location, unreadable application of the data) and bag-related errors (e.g., wrong number of medication doses, damaged medication doses) may occur during blister packaging or production of the strand. If a systematic error occurs, it may be advisable to stop the apparatus, so that production of a large number of defective blister bags is prevented. If a merely bag-related error is present, however, it is generally not advisable to stop the apparatus. In order to make it easier for a user to recognize a defective blister bag, it is further provided, in a preferred embodiment of the apparatus according to the disclosure, that the apparatus includes a marking device disposed between the optical detection device and the storage station and coupled with the control device, with which individual blister bags recognized as being defective may be marked. For example, it is conceivable to apply a noticeable color marking to a defective blister bag.

FIG. 1 shows an embodiment of an apparatus 1 according to the disclosure, where insignificant structural characteristics (e.g., the outer walls, display and input means, etc.) are omitted for the sake of simplicity.

The apparatus 1 includes a support structure or frame 4, on which a plurality of storage and dispensing stations 2 are releasably attached, and where a specific type of medication doses may be disposed in each storage and dispensing station 2. Usually, different medication doses are disposed in each storage and dispensing station 2. However, in the case of those medication doses that are in frequent demand, the same medication doses may be stored in multiple storage and dispensing stations 2.

The storage and dispensing stations 2 are disposed, in the embodiment shown, in two matrix structures 5 that lie opposite one another (of which only one matrix structure is shown). The matrix structures 5 enclose two first horizontal conveyor belts 6*a*, 6*b*, on which guide devices 7 are attached. The guide devices 7 are releasably attached by way of attachment elements 8 that are part of the two first conveyor belts 6*a*, 6*b*. In the embodiment shown, only some guide devices 7 are shown. However, a guide device 7 may be regularly attached to each attachment element 8 so that the two first conveyor belts 6*a*, 6*b* are completely provided with conveying devices.

In the embodiment shown, the guide devices 7 may be moved along the storage and dispensing stations 2 by way of the first conveyor belts 6*a*, 6*b*. As a result, parallel processing of order data becomes possible, because a guide device 7 moves past each available medication dose, and thereby a medication compilation may be processed with each guide device 7. A corresponding configuration of the guide devices 7 is not essential for the present disclosure, however. A single guide device 7 may also be made available, for example, which guide device 7 may pick up medication doses from all the available storage and dispensing stations 2.

The conveyor belts 6*a*, 6*b* are driven by way of drive rollers 12, which are coupled with a motor 11 by way of a vertical shaft 10. In order to prevent the first conveyor belts 6*a*, 6*b* from slipping through at the drive rollers 12, the first conveyor belts 6*a*, 6*b* are provided with surface contouring.

In order to be able to pick up medication doses from all the storage and dispensing stations 2, the guide devices 7 have multiple openings (not shown). In order to reduce the drop height of the individual medication doses in the guide devices 7, these guide devices 7 have a plurality of undercuts 14 (see FIG. 2), which are assigned to a horizontal row of storage and dispensing stations 2 in each instance.

The apparatus 1 may further include a second conveyor belt 15, which is disposed underneath the two first conveyor belts 6*a*, 6*b*, and which also has a plurality of attachment elements 16. A collection device 17 is attached to the attachment elements 16, in each instance, in which device medication compilations are temporarily stored before being passed over to a packaging station 3. The second conveyor belt 15 is also coupled with a motor 11 by way of a gear wheel (not shown) and a vertical shaft 10, so that the guide devices 7 and the collection devices 17 are moved at the same circulation speed. As may particularly be seen in FIG. 1, the matrix 5 of the storage and dispensing stations 2 and the two first conveyor belts 6*a*, 6*b* do not extend over the entire length of the conveyor belt 15, but rather are kept shorter with regard to the length of the apparatus 1, so that at a specific point within the apparatus 1, a separation takes place between the guide devices 7 and the collection devices 17.

In the embodiment shown, the guide 7 and collection devices 17, which together form a guide and collection arrangement, move synchronously together in the region of the storage and dispensing stations 2. Separation takes place at the end of the matrix structure 5 of the storage and dispensing stations 2. However, such an embodiment is not essential to the disclosure. In another embodiment of the apparatus according to the disclosure, which may be kept more simple, it is conceivable that the apparatus 1 has one or multiple combined guide and collection arrangements by which medication compilations are guided to the packaging station 3.

Figure 2:
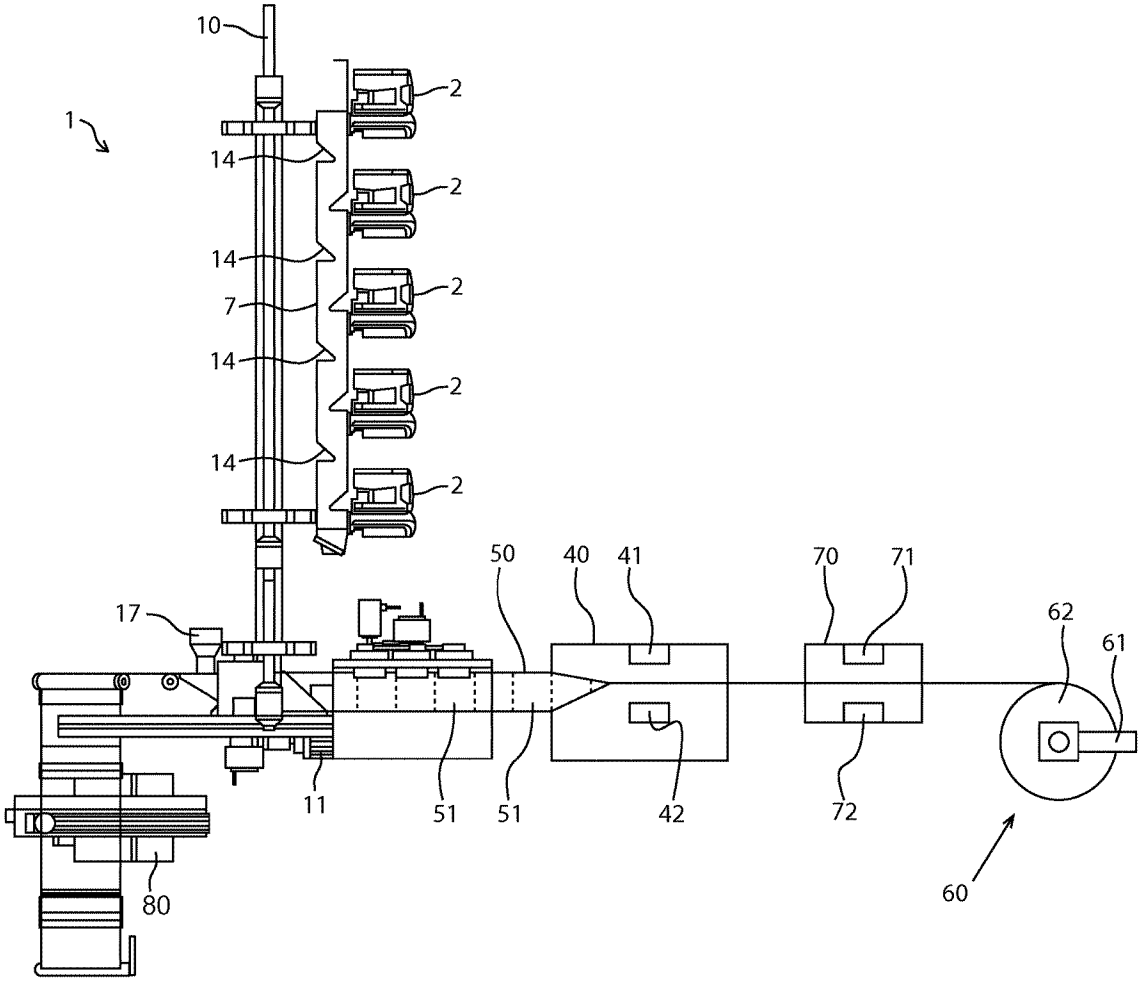
FIG. 2 is a side view of an embodiment of an apparatus for packaging individual medication doses.

In the embodiment shown in FIGS. 1 and 2, the collected medication compilations are passed to the packaging station 3 by the multiple movable collection devices 17. Making reference to FIG. 3, in the following the packaging station 3, as well as the components of the two embodiments of the apparatus 1 that are placed ahead of the packaging station 3 will be described.

The packaging station 3 has a supply roller 32 with packaging material 34 assigned to it. The supply roller 32 itself is moved by means of a drive 33. The packaging material 34 is guided to or through a labeling or printing station 45 coupled with a control device 80 (see FIG. 1), to apply data predetermined by the control device 80 to the packaging material 34 in a predetermined arrangement. Precisely how the predetermined data are applied to the packaging material 34 is dependent on the respective embodiment. For example, it is conceivable that the data are printed onto the packaging material 34, or that a label with the predetermined data is adhesively attached to the packaging material 34.

The packaging material 34 leaves the labeling or printing station 45 with the applied data 52, where the data are applied to the packaging material 34 in such a manner that for every subsequent blister bag to be formed, the data are disposed in an also predetermined position on the blister bag. Using two guide rollers 35, the packaging material 34 provided with data is passed to a shaping region of the packaging station 3, in which the packaging material 34 is folded in the center into a V shape, into which the medication compilations may be introduced when the collection devices 17 are opened.

The packaging material 34 is provided with one seal that runs longitudinally and two seals that run transverse to the transport direction, with sealed blister bags being formed by these seals. These blister bags are not separated from one another after being completed, but rather a strand 50 of connected blister bags 51 is formed.

Figure 3:
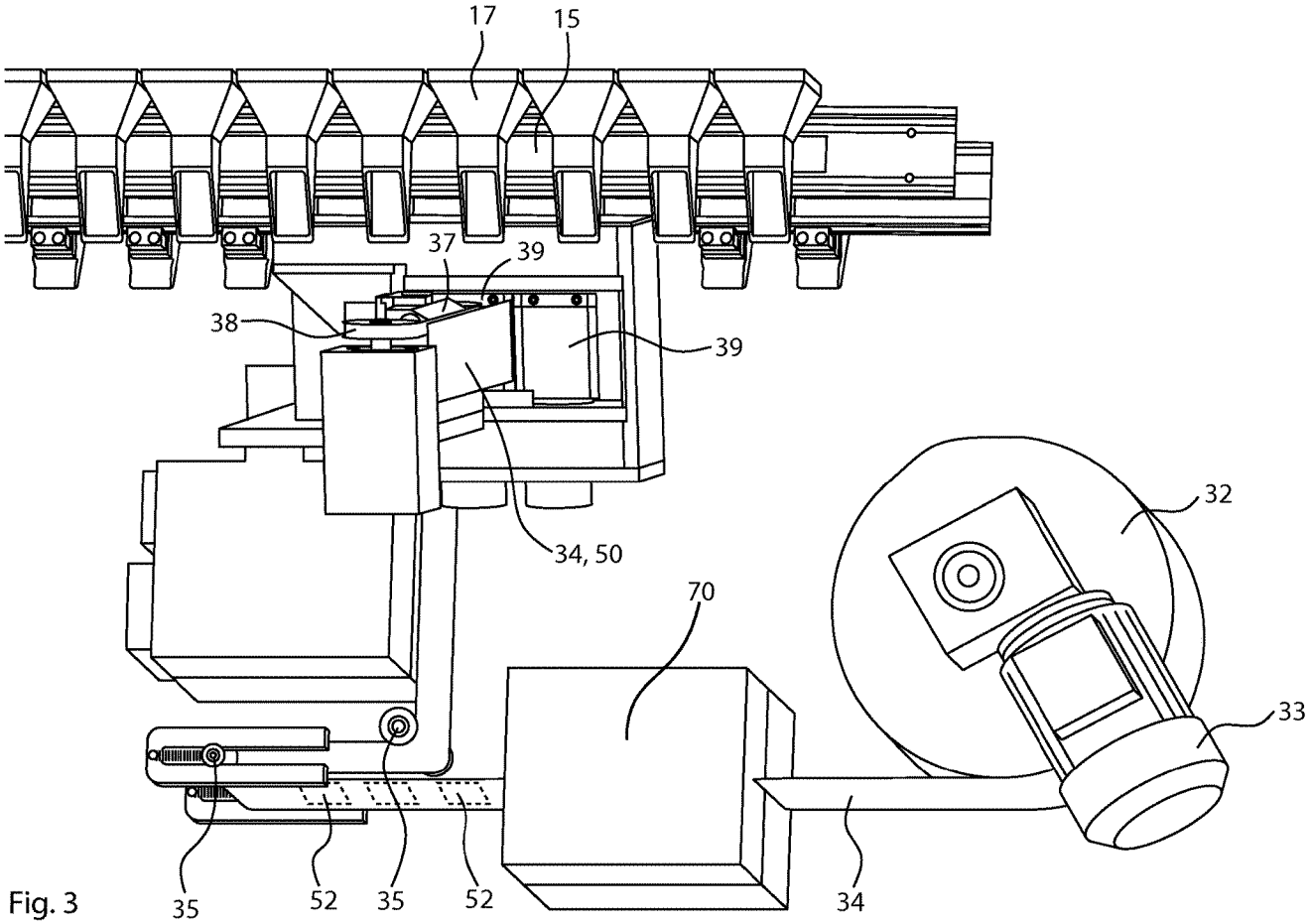
FIG. 3 is a perspective view of an embodiment of an apparatus for packaging individual medication doses.

For production of the longitudinal seal, two heaters 37 are provided, of which only one is shown in FIG. 3. The heaters 37 press the two upper ends of the packaging material 34, folded in a V shape, together, and seal them with regard to one another. Each heat bar 37 may engage the packaging material 34 via a stationary strip manufactured from plastic, in particular Teflon, or displaceable band 38 in order to prevent adhesion of heat bars 37 to the packaging material 34. The transverse seals of the blister bags are produced by two rotating heaters 39, which are coordinated to rotate with one another. On the basis of the advancing speed of the packaging material 34 and of the rotational speed of the rotating heaters 39, it is possible to precisely control the length and thereby the accommodation capacity of the blister bags.

When the blister bags are sealed or produced using heaters 37, 39, a corresponding packaging material 34 must be chosen. In some embodiments, it is possible to produce the individual blister bags in some other way, for which the packaging material 34 must be adapted accordingly. For example, a sealing material or an adhesive may be applied during production of the blister bags, with the blister bags being produced by way of their adhesion effect.

As may be seen in FIGS. 1 and 2, the strand 50 with the connected blister bags 51 is guided out of the packaging station 3 to an optical detection device 40 disposed downstream from the packaging station 3 and coupled with the control device 80. This optical detection device 40 includes at least one detector 41, which may be a camera, for example. Using the detector 41, characteristics of the blister bags passing through the detection device 40 are detected. In the simplest case, it is merely detected at what application location the data previously applied with the labeling or printing device are disposed, or whether there are any (readable) data at all disposed on the blister bags.

These characteristics of a blister bag that passes through the optical detection device 40 are compared with reference characteristics by an evaluation device 90 coupled with the control device 80 (see FIG. 1). Using the evaluation device 90, it may be compared or determined, for example, whether the applied data 52 have been applied to the blister bags at the correct or predetermined location.

Because the data are usually applied in a machine-readable form (e.g., in the form of a barcode), it is essential that they are applied in such a manner that they may be read by a machine. For this purpose, it is necessary that the data are disposed on the blister bag in a specific detection region of a machine that reads these data. If it is now determined, during the aforementioned comparison, that this is not the case, a bag-specific defect is present, at first, at the first blister bag for which this defect was determined. In order to also make this optically visible on the blister bag, the embodiment of the apparatus according to the disclosure shown in FIG. 2 includes a marking device 70, by which the blister bag recognized as being defective is optically marked by at least one marker 71, 72. For example, the bag may be marked with an optically noticeable color.

If the same or a similar defect is determined for blister bag(s) that follow the first defective blister bag, operation of the apparatus 1 may be stopped in reaction to the determined deviation, in order to keep the number of defective blister bags low. It depends on parameters that may be set for the control device 80 or the evaluation device 90 after how many deviations and after precisely what deviations stopping of the apparatus 1 is initiated.

In the event that the reference characteristics are derived from order data, these data also comprise characteristics with regard to the medication compilation contained in a blister bag. For example, the reference characteristics contain information as to how many medication doses a medication compilation comprises. In such a case, it is determined, using the optical detection device 40, and if necessary, also using an additional detector 42, how many medication doses are contained in a blister bag, and this number is compared with a corresponding reference characteristic. If it is determined that there is a deviation with regard to the number of medication doses, this blister bag is marked as being defective. As has already been explained, for this purpose the blister bag may be optically marked, but it may also be desirable to mark the order data as being defective or to schedule these order data for renewed processing, so that it is guaranteed that after all the order data have passed through, those order data in which an error might have occurred during the first compilation were also processed.

After the strand 50 has passed through the optical detection device 40, it is stored by a storage station 60. The storage station 60 includes a roller 62 that is driven by a motor 61. In an embodiment, the strand 50 may also be stored by being folded in an ordered manner.

Figure 4:
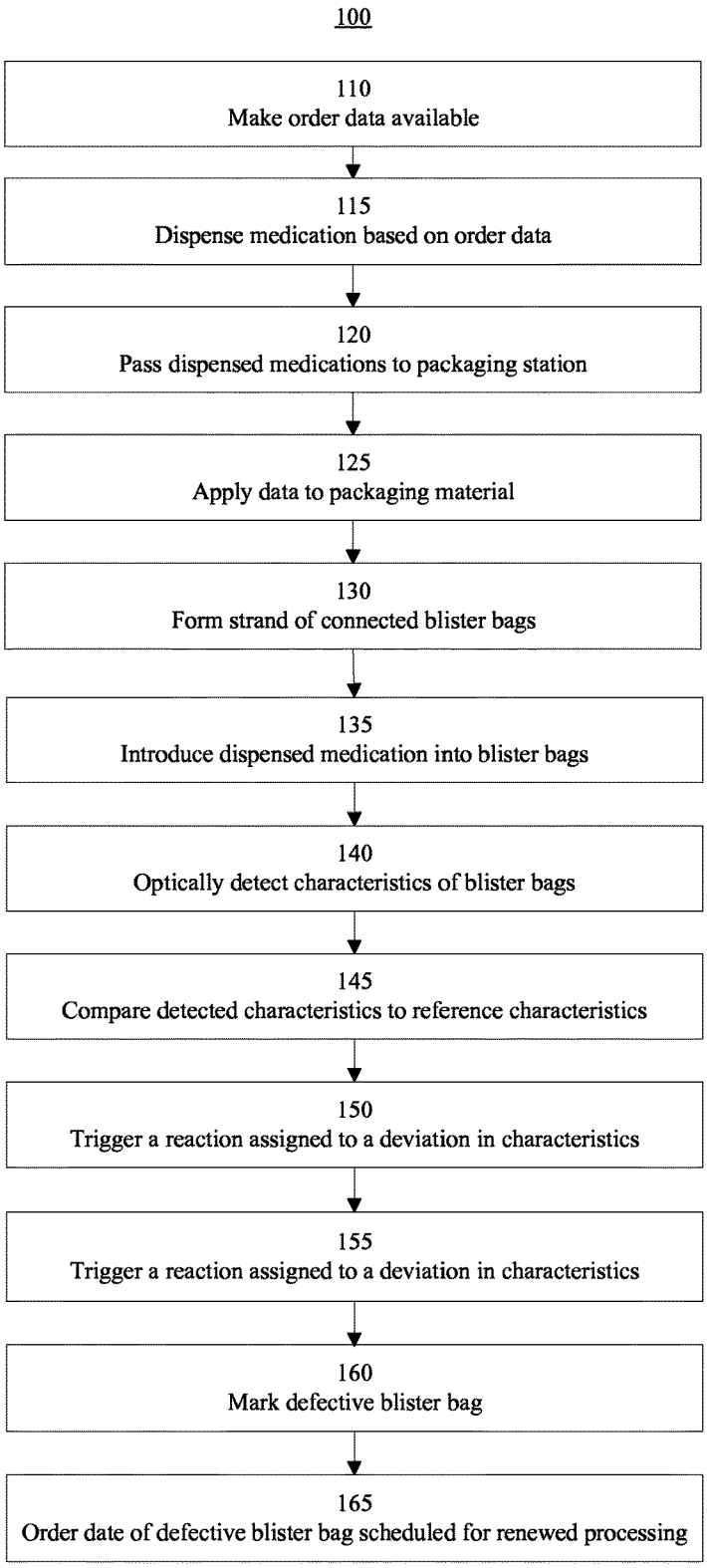
FIG. 4 is a flow chart illustrating steps in a method for packaging medications, according to some embodiments.

Methods consistent with the present disclosure may include at least one of the steps illustrated in FIG. 4, performed in any order. In some embodiments, a method may include at least two of the steps illustrated in FIG. 4 performed overlapping in time, or even simultaneously. Moreover, embodiments consistent with the present disclosure may include at least one but not all of the steps illustrated in FIG. 4. Furthermore, methods consistent with the present disclosure may include more steps, in addition to at least one of the steps illustrated in FIG. 4. In some embodiments, one or more steps may be repeated.

In a method 100, order data are made available to the control device 80, where these order data relate to medication compilations, each containing at least one medication dose, in step 110. In step 115, the storage and dispensing stations dispense medication doses of a medication compilation on the basis of the order data, and pass them to the packaging station by way of at least one guide and collection arrangement in step 120. Data are applied to the packaging material by the labeling or printing station at predetermined application locations in step 125. In step 130, the packaging station forms a strand of connected blister bags from the packaging material that is made available, with the data applied to and assigned to each blister bag (e.g., the blister bags being formed in such a manner that data previously applied are disposed on each bag). In step 135, the dispensed medication compilations are introduced into the blister bags.

The strand of connected blister bags produced in this manner is passed to an optical detection device and characteristics of the blister bags are optically detected in step 140. In step 145, the detected characteristics of a blister bag are compared with reference characteristics. If a deviation between the detected characteristics and the reference characteristics is determined, a reaction assigned to the deviation is triggered in step 150. In step 155, the strand of blister bags that leaves the optical detection device is placed in storage (e.g., stored in an ordered manner on a roller and the like).

Thus, it is possible to recognize systematic errors during application of the data to the packaging material 34. The optical detection device 40, which may comprise a camera, for example, detects predetermined characteristics of the applied data 52. In the simplest case, this may be merely the application location of the applied data 52. If the data are applied precisely in the center of the blister bag, for example (and thereby to a corresponding location of the packaging material) when the labeling or printing station is functioning correctly, and if it is determined, using the optical detection device 40, that the applied data 52 are disposed too far toward the outside of the blister bags, then the apparatus 1 may be stopped as a reaction to a threshold number, such as five consecutive defective blister bags, for example. In this manner, production of a large number of defective blister bags is prevented.

It depends on the type and frequency of the deviations to determine precisely what reaction is triggered. If, for example, a threshold number of correct blister bags (e.g., more than five blister bags) printed without errors follow one another again after a misprint of data, operation of the apparatus 1 may be maintained in spite of the misprint. Using the method according to the disclosure in its form as explained above, systematic errors may be recognized during application of the data, and the apparatus 1 may be stopped, if necessary, so that production of a large number of defective blister bags, which would have to be produced once again, may be prevented.

In order to also be able to react to errors in the medication compilation in a blister bag, it is provided, in a preferred embodiment of the method, that the reference characteristics are derived from the order data, and thereby the reference characteristics also contain information about the number of individual medication doses in a blister bag, for example.

In the optical detection of the characteristics of a blister bag, not only the application location of the data on the blister bag, for example, is then determined, but rather the number of individual medication doses, for example, is also determined. If it is determined, in this connection, that although the application of the data to the blister bag is error-free, a number of medication doses that does not agree with the reference characteristics was introduced into the blister bag, the blister bag may be marked as being defective in the case of such a bag-related deviation.

In a preferred embodiment, the order data assigned to the defective blister bag is furthermore marked as being defective in order to simplify finding the defective blister bag in the strand of connected blister bags subsequently, in step 160. In step 165, the order data of a defective blister bag are scheduled for renewed processing, so that it is possible, without the intervention of a user, to produce a blister bag with a medication compilation that corresponds to the order data, in spite of an initial defective compilation.

It is understood that any specific order or hierarchy of blocks in the methods of processes disclosed is an illustration of example approaches. Based upon design or implementation preferences, it is understood that the specific order or hierarchy of blocks in the processes may be rearranged, or that all illustrated blocks be performed. In some implementations, any of the blocks may be performed simultaneously.

The present disclosure is provided to enable any person skilled in the art to practice the various aspects described herein. The disclosure provides various examples of the subject technology, and the subject technology is not limited to these examples. Various modifications to these aspects will be readily apparent to those skilled in the art, and the generic principles defined herein may be applied to other aspects.

A reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention.

The word "exemplary" is used herein to mean "serving as an example or illustration." Any aspect or design described herein as "exemplary" is not necessarily to be construed as preferred or advantageous over other aspects or designs. In one aspect, various alternative configurations and operations described herein may be considered to be at least equivalent.

As used herein, the phrase "at least one of" preceding a series of items, with the term "or" to separate any of the items, modifies the list as a whole, rather than each item of the list. The phrase "at least one of" does not require selection of at least one item; rather, the phrase allows a meaning that includes at least one of any one of the items, and/or at least one of any combination of the items, and/or at least one of each of the items. By way of example, the phrase "at least one of A, B, or C" may refer to: only A, only B, or only C; or any combination of A, B, and C.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

In one aspect, unless otherwise stated, all measurements, values, ratings, positions, magnitudes, sizes, and other specifications that are set forth in this specification, including in the claims that follow, are approximate, not exact. In one aspect, they are intended to have a reasonable range that is consistent with the functions to which they relate and with what is customary in the art to which they pertain.

It is understood that the specific order or hierarchy of steps, operations or processes disclosed is an illustration of exemplary approaches. Based upon design preferences, it is understood that the specific order or hierarchy of steps, operations or processes may be rearranged. Some of the steps, operations or processes may be performed simultaneously. Some or all of the steps, operations, or processes may be performed automatically, without the intervention of a user. The accompanying method claims, if any, present elements of the various steps, operations or processes in a sample order, and are not meant to be limited to the specific order or hierarchy presented.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112 (f) unless the element is expressly recited using the phrase "means for" or, in the case of a method claim, the element is recited using the phrase "step for." Furthermore, to the extent that the term "include," "have," or the like is used, such term is intended to be inclusive in a manner similar to the term "comprise" as "comprise" is interpreted when employed as a transitional word in a claim.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way.

What is claimed is:

1. An apparatus for packaging individual medication doses, comprising:

a plurality of storage and dispensing stations configured to dispense individual medication doses based on medication order data;

at least one guide and collection arrangement configured to pick up the medication doses dispensed by the plurality of storage and dispensing stations and to convey the dispensed medication doses;

a packaging station coupled with a control device and configured to:

receive, from the at least one guide and collection arrangement, the conveyed dispensed medication doses; and form, from a received packaging material, a strand of connected blister bags by introducing the dispensed medication doses into the blister bags;

a labeling and printing station coupled with a control device and configured to apply, to the blister bags, data associated with the medication order data;

an optical detection device coupled with the control device and configured to optically detect 1) characteristics of an individual formed blister bag of the strand and 2) positions of the data on the blister bags;

an evaluation device coupled with the control device and configured to 1) compare the characteristics detected for the individual formed blister bag with reference characteristics based on the medication order data and 2) compare the positions of the data on the blister bags with predetermined arrangements; and a marking device coupled with the control device and configured to mark at least one individual formed blister bag when a defect is detected on the at least one individual formed blister bag based on the comparison by the evaluation device, wherein the control device stops operations of the apparatus when a systematic deviation between the positions of the data on the blister bags and the predetermined arrangements is detected based on the comparison by the evaluation device.

2. The apparatus of claim 1, further comprising a storage station configured to store the strand of the blister bags in an ordered manner.

3. The apparatus of claim 2, wherein the optical detection device is disposed between the packaging station and the storage station.

4. The apparatus of claim 1, wherein the labeling and printing station is part of the packaging station.

5. The apparatus of claim 1, wherein the evaluation device is configured to determine whether there is a deviation between the detected characteristics and the reference characteristics, and the defect is detected based on the deviation.

6. The apparatus of claim 1, wherein when a number of individual formed blister bags in which the systematic deviation is detected based on the comparison by the evaluation device satisfy a predetermined number, operation of the apparatus for packaging individual medication doses is stopped.

* * * * *